United States Patent [19]

Anazawa

[11] Patent Number: 4,872,592

[45] Date of Patent: Oct. 10, 1989

[54] ARTICLE STORAGE AND DISPENSING DEVICE WITH SOLD OUT INDICATING MECHANISM

[75] Inventor: Osamu Anazawa, Maebashi, Japan

[73] Assignee: Sanden Corporation, Gunma, Japan

[21] Appl. No.: 228,837

[22] Filed: Aug. 3, 1988

Related U.S. Application Data

[63] Continuation of Ser. No. 11,256, Feb. 5, 1987, abandoned.

[30] Foreign Application Priority Data

Feb. 5, 1986 [JP] Japan ..... 61-14450[U]

[51] Int. Cl.[4] ..... G07F 11/00

[52] U.S. Cl. ..... 221/6; 221/75

[58] Field of Search ..... 221/6, 14, 17, 75

[56] References Cited

U.S. PATENT DOCUMENTS

| | | | |
|---|---|---|---|
| 2,497,718 | 2/1950 | Earley et al. | 221/6 |
| 2,639,207 | 5/1953 | Ziska | 221/17 |
| 3,270,916 | 9/1966 | Lyman | 221/6 |
| 3,335,907 | 8/1967 | Holstein et al. | 221/75 |
| 4,319,742 | 3/1982 | Ulseth | 221/6 |
| 4,674,653 | 6/1987 | Suzuki | 221/75 |

*Primary Examiner*—Joseph J. Rolla
*Assistant Examiner*—Kenneth Noland
*Attorney, Agent, or Firm*—Banner, Birch, McKie and Beckett

[57] ABSTRACT

There is disclosed a sold-out detecting device for a vending machine for dispensing articles from a vertical stack in which there is a detecting plate pivotally supported and biased for movement against the stack, and a switch adapted to be closed by the detecting plate. The detecting plate extends along and is in contact with all of stacked articles to guide the same downwardly as articles are dispensed and to distribute contact pressure along the individual articles in the stack.

2 Claims, 4 Drawing Sheets

ARTICLE STORAGE AND DISPENSING DEVICE WITH SOLD OUT INDICATING MECHANISM

This application is a continuation, of application Ser. No. 011,256, filed Feb. 5, 1987, now abandoned.

BACKGROUND OF THE INVENTION

This invention relates to an article storage and dispensing device for use in an automatic vending machine, and more particularly, to a device for detecting an empty or sold-out condition of the stored articles, which device is adapted for use in an automatic vending machine with a flapper-plate type and/or a helix type storage and dispensing mechanism.

Flapper-plate type and helix type article storage and dispensing mechanisms are well known as shown for example, in the U.S. Pat. of Kurosawa et al., No. 4,542,334 and the U.S. Pat. of Holstein et al., No. 3,335,907. In the constructions disclosed in these two prior art patents, means are provided for detecting an empty condition of the stored articles and to stop the vending machines and to indicate the empty condition to customers.

Referring to FIG. 1, there is shown a prior art sold-out detecting device designed for use in the flapper-plate type dispensing device. Within a cabinet 1 there is a vertically extending storage space 2 and a flapper-plate type dispensing device 3 disposed in the lower portion thereof. A control shaft 4, which controls the operation of dispensing device 3, is adapted to be rotated by a motor 5 arranged vertically within the storage space 2. The dispensing device 3 comprises at least one of flapper-plate (not shown) pivotally supported within the cabinet 1 and adapted to open and close a discharge opening, and a control plate 31 attached to the lower end of the control shaft 4 to open and close the flapper-plate as the control shaft 4 is rotated. The dispensing device 3 also includes an article holding element (not shown) to hold the next to last article in the stack of articles while the discharge opening is open and the lowermost article A1 is being dispensed.

As described in U.S. Pat. No. 4,542,834, in a device of this nature, the articles A which are stacked vertically on the flapper plate, are discharged one by one as the flapper-plate and control plate are operated. The means for detecting a sold-out condition comprises a microswitch 6 disposed in the cabinet 1 adjacent the lowermost article A1 and a pivoted plate 7 normally urged against the lowermost article A1 and having an arm adapted to engage the microswitch 6. If the articles are sold-out, the microswitch 6 is closed by the plate 7 to energize a sold-out light or indicator.

As articles are dispensed from the stack, the lowermost article drops onto the flapper-plate by sliding downwardly between the wall of the cabinet 1 and the plate 7. However, if the weight of the articles being dispensed is relatively light, the last article A3, without the benefit of the weight of any articles stacked on it, may not be sufficient to pivot the plate 7 out of the way or otherwise to move smoothly past the plate 7 and to come to rest on the flapperplate when the next to last article A2 is dispensed. Accordingly, the last article A3 in the stack can become hung-up and will not be dispensed, and thus, the sold-out indicator will not be actuated even though the cabinet will not dispense any further articles.

SUMMARY OF THE INVENTION

It is the primary object of this invention to provide an improved sold-out detecting device for an article dispenser that will effectively indicate a sold-out or empty condition but will not interfere with the dispensing operation.

It is another object of this invention to provide an empty or sold-out detecting device for an article dispenser that is simple in construction.

In accordance with this invention, there is provided in a dispenser from which articles are adapted to be dispensed from a stack, means for detecting a sold-out condition that comprises a plate arranged generally parallel to the stack and pivotally mounted for movement toward and from the stack about an axis that is generally parallel to the stack whereby, when the last article has been dispensed, the plate will move into contact with and thus operate a sold-out switch.

Further objects and features of this invention will be understood from the following detailed description of the preferred embodiment with reference to the annexed drawings.

DETAILED DESCRIPTION

Figure 1:
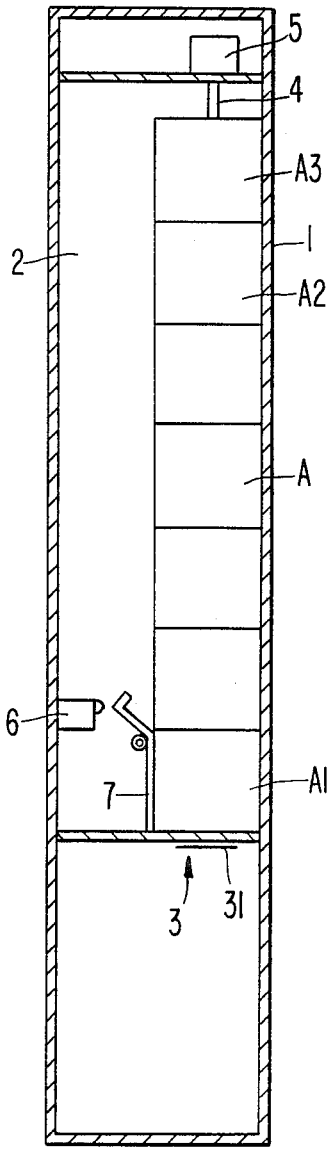
FIG. 1. (PRIOR ART)
FIG. 1 is a verticle sectional view of a prior art flapper-plate type article storage and dispensing device.
Figure 2:
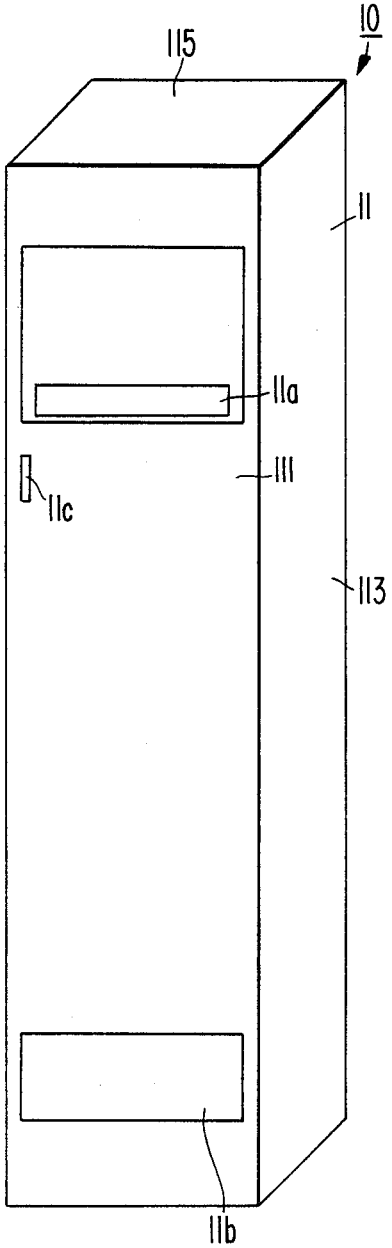
FIG. 2 is a perspective view of an automatic vending machine provided with an article storage and dispensing device in accordance with one embodiment of this invention.

Referring to FIGS. 2 to 5, there is shown an automatic vending machine 10 provided with an article storage and dispensing device 20 according to one embodiment of this invention.

The vending machine 10 includes an outer cabinet 11 comprising a front panel 111, back panel 112, pair of side panels 113, 114, upper panel 115 and bottom panel 116. The front panel 111 is provided with a space **11*a* at its upper portion for displaying the articles and for the control switches, an article dispensing opening 11*b* at its lower portion and a coin slot 11*c***.

The cabinet 11 is divided into three chambers including a motor chamber 12, an article storage chamber 13 and an article dispensing chamber 14. The motor chamber 12 is defined by the upper panel 115 of the cabinet 11 and a first support plate 15 disposed horizontally in the upper portion of the cabinet 11 and extending about half way across the cabinet 11 from back to front (see FIG. 4). The article storage chamber 13 is defined by the first support plate 15 and a second support plate 16 disposed horizontally in the lower portion of the cabinet 11 and extending about half way across the cabinet side to side (see FIG. 5). The article dispensing chamber 14 is defined by the second support plate 16 and the bottom plate 116 and has the article dispensing opening 11*b* opening into the same.

The article storage and dispensing device 20 includes a rotatable shaft 21, and first and second flapper-plates 22, 23. Rotatable shaft 21 is journalled vertically within the storage chamber 13 in the first and second support plates 15 and 16. The upper end of the shaft 21 extends into the motor chamber 12 and is coupled therein to a motor 24 which is mounted on first support plate 15. One side of the storage chamber 13 functions as the space for storing a stack of the articles A which, to provide for gravity feed of the articles A, is vertical.

The first flapper-plate 22 extends transversely across the storage chamber 13 from front to back and is pivotally supported on the front and back panels 111 and 112 by a pivot pin 222 for swinging into contact with the next to lowermost article A′ in the stack of article A. The plate 22 is adapted to be engaged by a control plate 221 affixed on the shaft 21, whereby, as the shaft 21 is rotated, the control plate 221 moves against the plate 22 and cams it against the article A′. The article A′ is thus clamped between the side planel 114 of the cabinet and the first flapper-plate 22 and held in position while the lowermost article A″ is dispensed.

Figure 3:
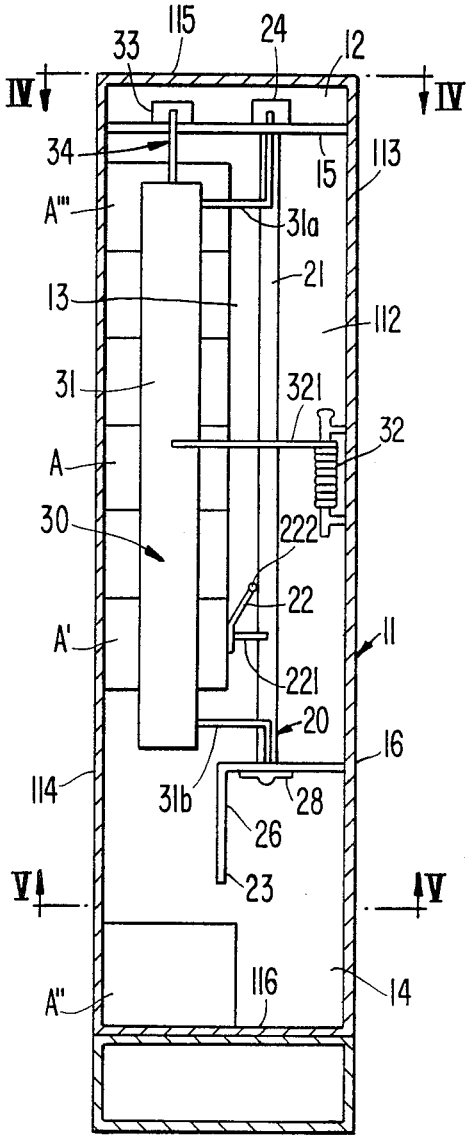
FIG. 3 is a vertical cross sectional view transversely of the vending machine of FIG. 2.

The second flapper-plate 23 is pivotally supported on the outer edge of the second support plate 16 by a pivot 26 and is adapted to receive and to support the stack of articles A. The second flapper-plate 23 is adapted to be swung about the pivot 26 between a horizontal position in which it supports the stack of articles A and a vertical position as shown in FIG. 3 where it has released the lowermost article A″. To actuate the flapper-plate 23 there is provided a second control plate 28 which is affixed on the shaft 21 and adapted to contact the bottom of the second flapper-plate 23 as the control plate 28 is rotated with the shaft 21.

A sold-out detecting device 30 is disposed in the storage chamber 13 and comprises an elongated detecting plate 31, a torsion spring 32 for biasing the detecting plate 31 against the stack of articles A, and a microswitch 33 for illuminating the "sold-out" indicator. The sold-out detecting plate 31 is arranged vertically within the storage chamber 13 along side and parallel to the stack of articles A, and substantially spans the stack of articles whereby it is contact with all of the articles in the stack. The detecting plate is pivotally supported on the first and second supported plate 15 and 16 through pivot arms 31*a* and 31*b* that provides an offset pivot axis that is parallel to the axis of the stack, and is therefore vertical, whereby the detecting plate 31 is adapted to be swung toward and away from the stack of articles.

Figure 4:
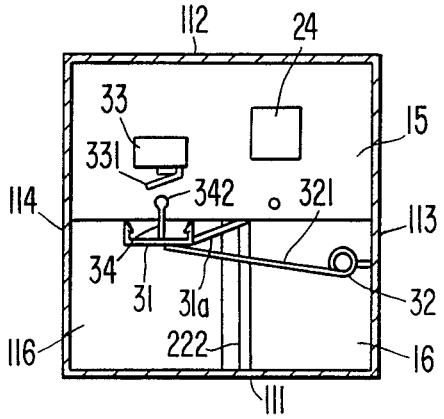
FIG. 4 is a horizontal cross sectional view taken along the line IV–IV in FIG. 3.
Figure 5:
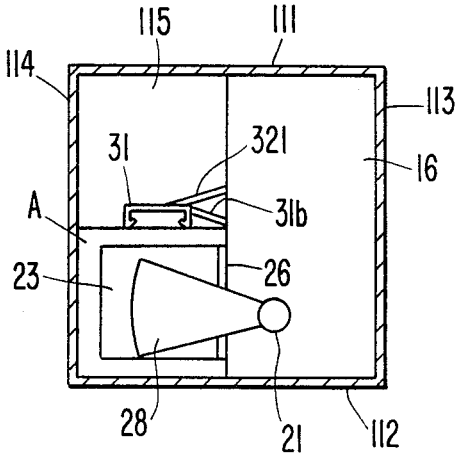
FIG. 5 is a horizontal cross sectional view taken along the line V–V in FIG. 3.

Sold-out detecting plate 31 is biased toward the articles A by an arm 321 of the torsion spring 32 which is coiled about a spindle supported on the side panel 113. As shown in FIGS. 4 and 5, the detecting plate 31 is formed U-shaped in cross section with the free ends thereof adapted to contact the articles A.

An L-shaped arm 34 includes a vertical portion 341 secured to the upper portion of detecting plate 31 and extending vertically from the upper portion thereof toward the upper panel 115. At its upper end, the vertical portion 341 carries a horizontal portion 342 that extends into the motor chamber 12 to engage the switch element 331 of a microswitch 33. The arm 34 thus moves with the detecting plate 31 and is adapted to close the microswitch 33 to actuate the sold-out indicator.

In operation, a plurality of articles A are vertically stacked on the second flapper-plate 23. When the motor 24 is energized by a signal from the vending machine, the shaft 21 is rotated by the motor 24. As the shaft 21 rotates the first control plate 221 contacts the first flapper-plate 22 and forces it about its pivot against the article A′ which is next to the bottom in the stack and thus clamps it against the side wall 114 of the cabinet 11. As the shaft 21 continues to rotate, the second control plate 28 is rotated out of contact with the second flapper-plate 23 which, when it's finally released, drops to the horizontal position as illustrated in FIG. 3 thereby releasing the lowermost article A″. Upon rotation of the shaft 21 through an angle of ninety degrees, the motor 24 is reversed thereby swinging the second control plate 28 under the second flapper-plate 23 and restoring it to its horizontal or stack-supporting position. At the same time the control plate 221 swings away from the first flapper-plate 22 to release the article A′ which then drops onto the second flapper-plate 23.

As each article is dispensed the remaining articles in the stack slide downwardly along the inner surface of cabinet 11 and along the detecting plate 31 onto the second flapper-plate 23. When the last article A″ in the stack is dispensed, the detecting plate 31 is free to move under the bias of the spring 32 toward the back panel 112. As the detecting plate 31 moves, the horizontal element 342 of the arm 34 contacts the switch element 331 of the microswitch 33 to close the same and thus energizing the sold-out indicator.

As mentioned above, the detecting plate 31 extends along the side surface of the stacked articles and is maintained in contact therewith by the torsion spring 32. The detecting plate 31 is elongated sufficiently to span the entire stack of article A which not only distributes the contact pressure but also guides the articles as they move downwardly and thus keep them aligned.

Figure 6:
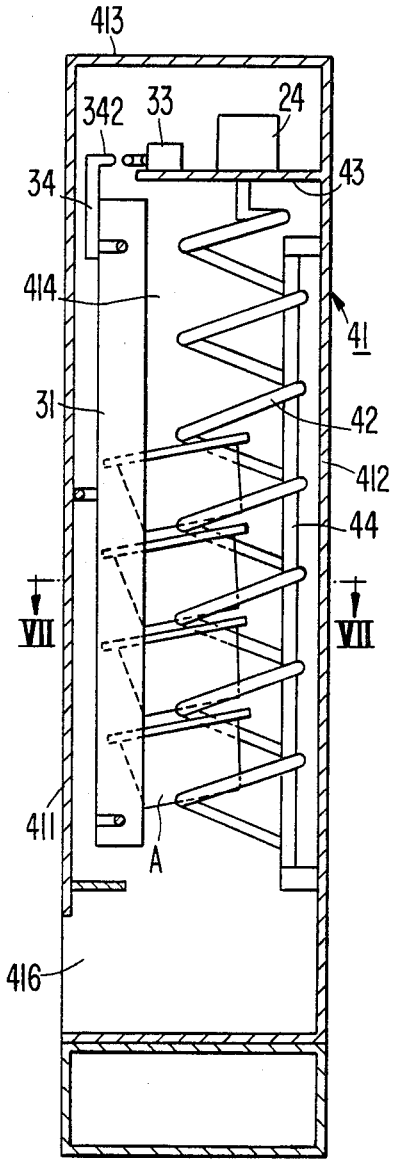
FIG. 6 is a vertical sectional view of a vending machine according to another embodiment of this invention.
Figure 7:
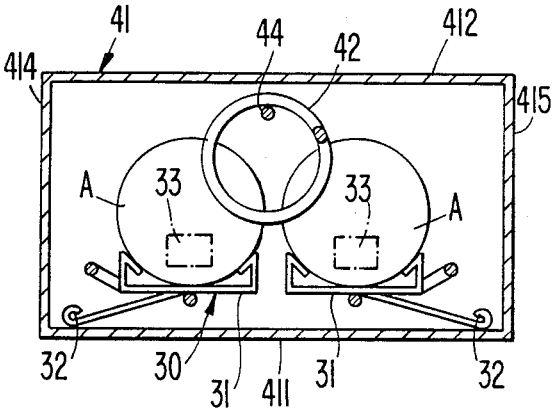
FIG. 7 is a cross sectional view taken along the line VII-VII in FIG. 6.

Referring to FIGS. 6 and 7, there is disclosed another embodiment of the invention in which the sold-out detecting device 30 is used in a helix-type dispensing device comprising a cabinet 41 having a front wall 411, a rear wall 412, a top wall 413, left and right side walls 414, 415 and a lower opening 416 in the front wall 411. A helical element or coil 42 extends vertically within cabinet 41 to form a continuous spiral on which the articles are supported. The upper end of helical element 42 is coupled to the motor 24 which is mounted on an upper support plate 43 in the upper portion of the cabinet 41. A rod 44 extends vertically along the inner surface of the helical element 42 and is fixed on the rear wall 412 to restrict distortion of the helical element 42. The articles A are supported on the helical element 42 in two stacks as shown in FIG. 7.

A pair of detecting plates 31 of a sold-out detecting device 30 extends vertically along the stacks of articles A each of which plates is pivotally supported on the cabinet 41 through pivot arms that may be similar to the pivot arms 31a, 31b. Each detecting plate is normally biased toward the helical element 42 by a torsion spring 32 disposed on the front wall 411 of the cbinet 41. An arm 34 is affixed to the upper portion of each of the detecting plates 31 and includes a horizontal element 342 that is adapted to engage the switch element of a microswitch 33 mounted on the upper support plate 43.

In this embodiment in which there are two stacks of articles A, the sold-out detecting device is adapted to be energized when both of the microswitches are closed. When the motor 24 is energized by a signal from the vending machine, the helical element 42 is rotated through an angle of 180 degrees and dispenses one article from one stack or the other through lower opening 416. As each article is dispensed, the remaining articles in the stack slide downwardly along the detecting plate 31.

When the articles in one of the two stacks is sold-out but the other row still holds an article, the detecting plate 31 which faces the sold-out row moves forward to close its microswitch 33. the sold-out indicator however is not energized until after the articles in the other stack are also sold out and both microswitches are thus closed.

This invention has been described in detail in connection with the preferred embodiments, but these are examples only and this invention is not to be considered as restricted thereto. It will be easily understood by those skilled in the art that other variations and modifications can be made within the scope of this invention as claimed.

I claim:

1. An article storage and dispensing device comprising:

a cabinet;

article supporting and dispensing means for contiguously supporting said articles in a vertical stack and for individually dispensing said articles;

article aligning and detecting means for aligning said articles and for detecting when all of said articles have been dispensed, said article aligning and detecting means comprising a detecting plate substantially spanning the entire height of said stack of articles and an arm extending from said detecting plate, said detecting plate engaging said articles to align said articles in said stack;

mounting means for pivotably mounting said article aligning and detecting means in said cabinet, said aligning and detecting means pivotable about a vertical pivot axis offset relative thereto to allow pivotal movement of said aligning and detecting means in a direction toward and from said stack of articles;

biasing means for biasing said aligning and detecting means toward said stack of articles; and sold-out indicator switch means for indicating a sold-out condition of said device, said arm disposed adjacent said indicator switch means, said detecting plate pivoting about said pivot axis when all of said articles from said stack have been dispensed, said sold-out indicator switch means engaged and actuated by said arm upon pivotal movement of said detecting plate to indicate a sold-out condition of said device.

2. The device recited in claim 1, said stack of articles disposed between a rear wall of said cabinet and said detecting plate, said switch means comprising a microswitch disposed above and non-contiguous with said stack of articles, said arm including a vertical portion extending from the top of said detecting plate and a horizontal portion extending from said vertical portion and disposed adjacent said microswitch, said detecting plate pivoting towards said rear wall when all of said articles have been dispensed such that said horizontal portion engages said microswitch.

* * * * *